United States Patent [19]

Kicherer et al.

[11] Patent Number: 4,936,457

[45] Date of Patent: Jun. 26, 1990

[54] HOTPLATE STACKING AID

[75] Inventors: Robert Kicherer, Oberderdingen; Josef Krist, Eppingen, both of Fed. Rep. of Germany

[73] Assignee: E.G.O. Elektro-Gerate Blanc u. Fischer, Fed. Rep. of Germany

[21] Appl. No.: 235,431

[22] Filed: Aug. 23, 1988

[30] Foreign Application Priority Data

Aug. 27, 1987 [DE] Fed. Rep. of Germany ..... 3728541

[51] Int. Cl.[5] ..... B65D 21/02; B65D 85/62

[52] U.S. Cl. ..... 206/499; 206/320; 206/821; 29/842

[58] Field of Search ..... 206/320, 332, 499, 821

[56] References Cited

U.S. PATENT DOCUMENTS

| | | | |
|---|---|---|---|
| 2,662,638 | 12/1953 | Storer | 206/499 |
| 3,008,572 | 11/1961 | Wagner | 206/499 |
| 3,089,589 | 5/1963 | Fallert | 206/499 |
| 3,191,791 | 6/1965 | Jackson | 206/332 |
| 3,306,439 | 2/1967 | Storey | 206/499 |
| 3,904,030 | 9/1975 | Repp | 206/821 |
| 4,098,400 | 7/1978 | Brown | 206/821 |
| 4,255,626 | 9/1980 | Chiu | 206/821 |
| 4,349,109 | 9/1982 | Scordato | 206/499 |
| 4,699,269 | 10/1987 | Kicherer et al. . | |

FOREIGN PATENT DOCUMENTS

| | | | |
|---|---|---|---|
| 3227139 | 5/1983 | Fed. Rep. of Germany | 206/499 |

*Primary Examiner*—George E. Lowrance
*Attorney, Agent, or Firm*—Steele, Gould & Fried

[57] ABSTRACT

For the transportation-storage and assembly stacking of electric hotplates (2), a stacking air has pallet plates (10) to be arranged in superimposed manner in stacking layers and which can be directly stacked in one another for storage and which are in the form of deep drawn plastic plate parts with grid-distributed flat shells (19), which in each case projecting beyond the open side with the cooking surface (4) receive in centering manner the lower part of an electric hotplate (2) and are supported with respect to the cooking surfaces of the adjacent stacking layer by means of a slide preventing means (31), but are otherwise contact-free. Thus, on a support pallet and protected by a packing sleeve it is possible to stack a very large number of hotplates (2) in a stable manner, with the same orientation and therefore having good assembly access. Following an assembly process performable fully automatically with programmable handling means, the in each case necessary hotplates (2) are set down oriented upside down and then a mounting plate is mounted upside down and secured with a locking part with respect to the hotplates. Then, optionally by spot welding joints, the connecting members (33) of hotplate (2) are connected to a connecting piece for connecting lines and the thus formed assembled mounting plate is supplied to a stack.

22 Claims, 4 Drawing Sheets

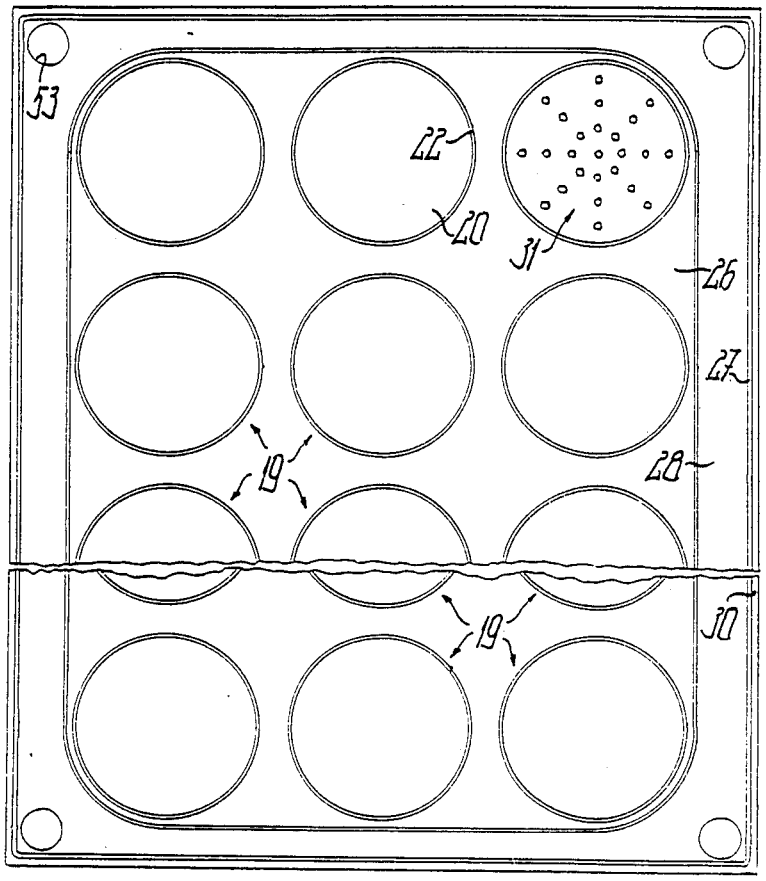
Fig. 2
Fig. 3
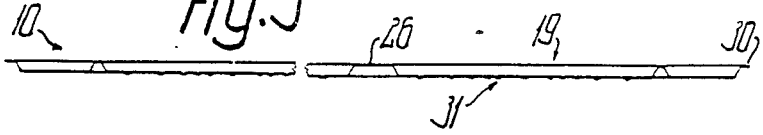

HOTPLATE STACKING AID

BACKGROUND OF THE INVENTION

1. Field of the Invention

The invention relates to a hotplate stacking aid having bearing surfaces provided on intermediate members to be disposed between superimposed hotplates.

2. Prior Art

Such stacking aids, which can have different stacking spacers for the standard components to be stacked in juxtaposed and superimposed form, generally serve to give the stacked standard components an adequate stability and keep them at an adequate distance from one another.

Hitherto, in the case of electric hotplates, plan view circular stacking members have been used, which are constructed in such a way that they can in each case receive two hotplates in inverted orientation with their undersides facing one another, the stacking members of adjacent stacking columns not being directly interconnected. Although this has led to satisfactory results for certain types of hotplate, particularly those with central studs projecting beyond the underside and projecting connecting member, essentially every other hotplate must for assembly purposes be turned into the desired assembly starting position.

SUMMARY OF THE INVENTION

The problem of the present invention is to provide a hotplate stacking aid of the aforementioned type enabling the hotplates to be stacked in such a way that most or all the hotplates are in the same orientation, i.e. either with the cooking surface at the top or at the bottom.

In the case of a hotplate stacking aid of the aforementioned type, this problem is inventively solved by providing flat shells to be supportedly arranged between superimposed hotplates with a centering effect. The flat shells, dishes or trays, which can act in the manner of circular stacking members, in simple manner ensure a centering adapted to the upper or lower circumference of the particular hotplate. Juxtaposed, adjacent flat shells are interconnected by their union in the common pallet plate, so that in the in each case associated stack layer, the stacking columns in the vicinity of a pallet plate are securely reciprocally, directly interconnected, so as not to be impaired by transverse or tilting forces, more particularly occuring as tensile forces. Superimposed flat shells or pallet plates, which can be identically or differently constructed, are preferably reciprocally supported so as to be completely contact-free substantially solely via the hotplates positioned between them, although it would be conceivable to have a minor supporting contact of superimposed pallet plates in the areas between the flat shells and/or in the marginal area of the pallet plates, e.g. in such a way that in each case one pallet plate forms a cover for the adjacent pallet plate and consequently the intermediate hotplates are located in an area or space substantially completely closed to the outside and are consequently protected against the penetration of atmospheric humidity. However, each flat shell is appropriately only in centering engagement with a single hotplate and superimposed flat shells or hotplates can be equiaxial to one another over the entire height of the associated stacking column. If compared with the hotplate height, the flat shell height is approximately the same or greater, then through the cooperation of two superimposed pallet plates, it is possible to form individual, reciprocally substantially closed reception chambers for in each case one, two or more hotplates.

It is conceivable to form adjacent flat shells by separate components and to interconnect them by e.g. redetachable connecting members, such as locking members located in their planes, so that it is possible to achieve a very space-saving storage or a corresponding transportation state.

As a result of the inventive construction the hotplate bodies of the superimposed electric hotplates are compressively loaded under the stacking pressure over the entire height thereof, namely between the lower ring face of an outer flange edge and the cooking surface, so that even in the case of a very great stack height there is no overloading of the lowermost hotplates which are subject to the greatest stack pressure and optionally sheet metal or the like shield-like profile support rings fixed thereto can be completely unloaded, namely substantially exposed. The bottom of at least one flat shell of at least one pallet plate, whose bottom outside is supported on the cooking surface or the underside remote therefrom of the hotplate adjacent thereto in the height direction is appropriately provided with a slip preventing means, which can be formed by a support surface, which is smooth or continuously planar, or is e.g. profiled with projecting studs and optionally an additional, laminated spacer having a high friction coefficient.

The side of the pallet plate remote from the shell openings can be substantially continuously planar, so that the pallet plate has different wall thicknesses and a relatively high bending rigidity, but it is particularly appropriate if the pallet plte is constructed elastically and flexibly in such a way that adjacent flat shells move in hinge-like manner with respect to one another and can undergo resilient deformation in such a way that they undergo automatic adaptation under the stacking pressure in the vicinity of their support surfaces in order to ensure constant specific surface pressures. In particular in the case of such a construction, which is e.g. formed by a deep-drawn plastic plate with a thickness of approximately 1 mm, it is also possible in simple manner to stackably construct the pallet plates so as to engage in one another in centered manner, so that the associated stack height correpsonds to the number of stacked pallet plates multiplied by their wall thickness, plus the thickness or height of a pallet plate. As a result the pallet plates can be transported in space-saving manner for reuse following the removal of the hotplates.

In order to be able to particularly stably support and also safely move by road the complete stack, which e.g. with approximately 32 stacking layers of in each case approximately 12 to 24 hotplates representing a total of 384 to 768 hotplates and having a total weight of up to one ton, it is appropriate to provide a stable support pallet, which can e.g. be formed by a so-called EURO pallet or a Pool pallet. It is also advantageous for this purpose if the top of the stack is braced against the stack underside, in addition to the dead weight stack pressure and appropriately for this purpose on the top of the stack is engaged a grating plate, which is braced with tension members, e.g. bands surrounding the stack against the upper plate grating of the support pallet. After removing the hotplates the pallet plates stacked in one another can be placed on the supported pallet and can be braced between the grating plate placed thereon and the support pallet for return transport.

As protection against dirtying, it is appropriate to provide a packing sleeve receiving the pallet stack, which can be formed by a cardboard container with a removable lid standing on the support pallet, so that it can be completely and easily removed by destruction and consequently the hotplate stack is rendered readily accessible. However, the cardboard container can also be left undestroyed and emptied.

The invention also proposes a method for the assembly of electric hotplates, which in particular involves using the aforementioned stacking aid, but can also be used where the hotplates are supplied in same other way. In order to permit a substantially fully automated assembly of a mounting plate to be fitted as a standard component in the top of a table plate or a cooker casing using a handling automation, it is proposed to remove the particular hotplate from its operating state using a handling automaton and using the latter and optionally accompanied by reversal to so align the same with the cooking surface at the bottom that both with respect to its position in a surface field and with respect to its rotation position, based on its central axis, the hotplate can be placed in a correct assembly position on a support surface e.g. formed by an assembly table. On the aligned electric hotplate with an upwardly directed underside and generally together with further hotplates provided for fitting in the mounting plate, the latter is so engaged in the upside down position that its mounting opening or openings from the underside of the hotplate or hotplates comes into engagement therewith in the correct form, in which the bottom-located top of the mounting plate is adjacent to the mounting openings on the supported edges of the support rings of the hotplates. A clamping part can then be placed from above on the underside of the mounting plate and e.g. with a fastening or threaded bolt engaging in a central stud of the particular hotplate it is fully automatically braced between the hotplate or between all the hotplates together and the mounting plate that the support ring or rings are resiliently braced against the bottom-located top of the mounting plate. Optionally prior to applying or bracing the clamping part and in particular thereafter, electrical connecting members, provided on the bottom of each hotplate appropriately in the form of parallel pins are fully automatically connected to a single common or several separate connecting pieces for leads. The connecting piece can be moved roughly parallel to the plane of the underside of the particular hotplate to the connecting members thereof until during this movement it has passed in self-threading manner into electrically conducting engagement with the connecting members and is carried by the latter. As the application of the mounting plate and the clamping part can also be carried out fully automatically with the handling automaton, a very simple and reliable installation occurs.

The removal of the fitted mounting plate from the support surface and its supply to a mounting plate stack can also take place fully automatically using handling automations. This mounting plate can e.g. be performed by a sheet metal profile plate, but can also be made from hand glass and in this case the hotplates can be constructed in the manner of radiant heaters, whose cooking surface is formed by the hard glass plate.

So as to permit easy detection of the hotplates to be removed from the stack and its alignment by a sensor controlling the handling automaton, it is possible to provide in the stack or in each stack layer markings for the particular hotplate, which are e.g. arranged in the form of holes on the edge of the pallet plate or are applied directly to the particular hotplate. It is also conceivable to move the particular hotplate stack, e.g. after removing the packing sleeve and using an automatically controlled trolley or carriage into the assembly position on the assembly machine having the handling automaton. As a result of the inventive construction an adequate stability of the stack even in the case of an emergency stop can be ensured.

These and further features of preferred further developments of the invention can be gathered from the claims, description and drawings and individual features can be realized in an embodiment of the invention and in other fields, either singly or in the form of subcombinations and can represent advantageous, independently protectable constructions, for which protection is hereby claimed.

BRIEF DESCRIPTION OF THE DRAWINGS

Embodiments of the invention are described in greater detail hereinafter relative to the drawings, wherein are shown:

FIG. 2: A pallet plate of the stack according to FIG. 1 in plan view.

FIG. 3: A section through the pallet plate according to FIG. 2.

DETAILED DESCRIPTION OF THE PREFERRED EMBODIMENTS

Figure 1:
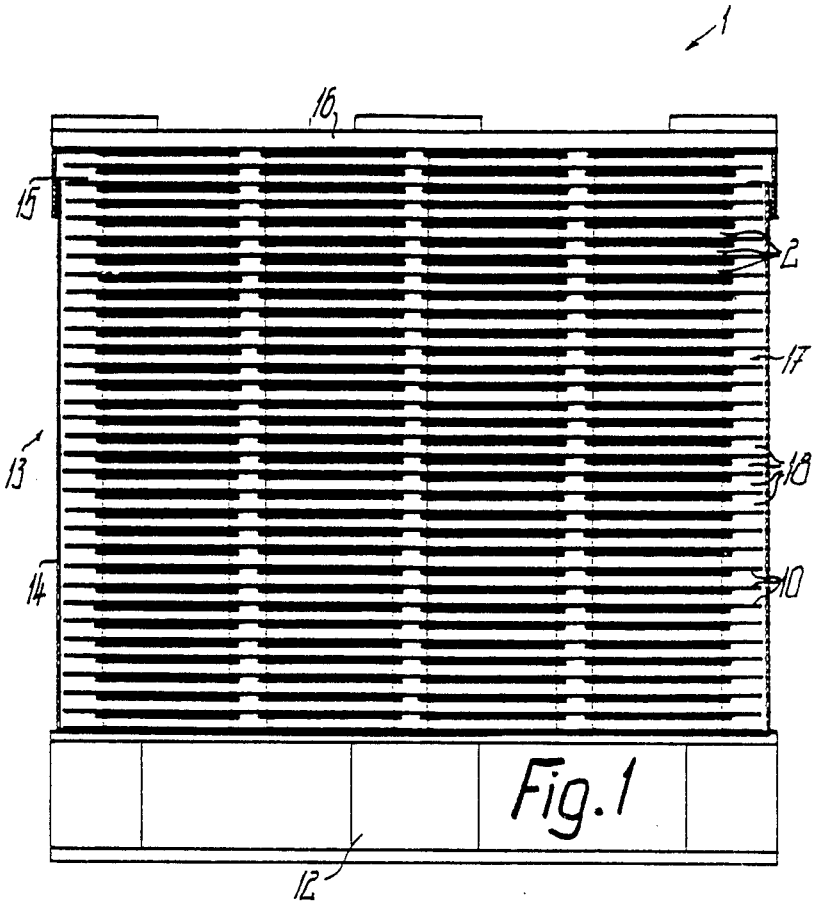
FIG. 1: A hotplate stack built up with inventive stacking aids in a part sectional transportation state.
Figure 4:
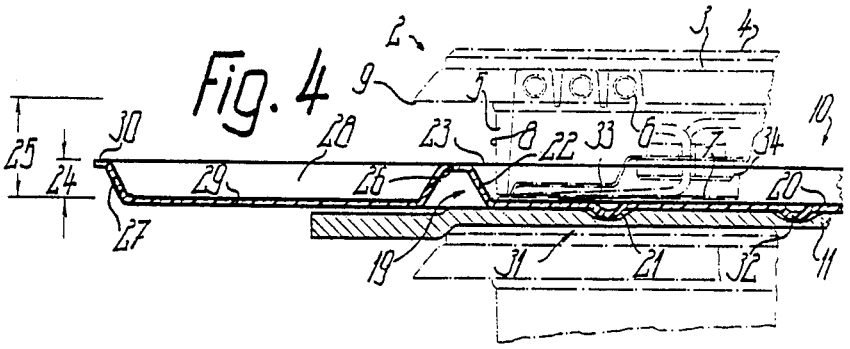
FIG. 4: A detail of FIG. 3 on a larger scale and with indicated hotplates.

As can be seen in FIGS. 1 to 4 an inventive stacking aid 1 comprising several stacking members to be assembled to form a stacking spacer means is provided for stacking in both successive and juxtaposed manner in a field pattern or grid electric hotplates 2 in such a way that juxtaposed vertical stacking columns of the same height are formed. The stacking aid 1 is in particular suitable for those electric hotplates 2 which in dot-dash manner in FIG. 4 have in each case a cast material or the like hotplate body 3 with a planar, circular cooking surface 4 on the top, which surrounds a lowered central zone, in which the hotplates 2 in plan view are circular, angular, rectangular or square. The hotplate body 3 has a flange edge 5 projecting on the bottom surface and which is inwardly displaced with respect to the outer circumference of the cooking surface 4 and within the flange edge 5 or between the latter and an inner flange edge projecting less far downwards on the underside one or more spiral grooves, in which are inserted one or more heating resistors 6 pressed in a ceramic insulating material. The underside of the area of the hotplate body 3 located within the outer circumference 8 of the flange edge 5 is closed by a profiled cover plate 7 of sheet metal or the like, which e.g. engages on the lower, circular end face of flange edge 5, at the most projects downwards beyond said end face by its material thickness and can e.g. be secured by bracing against a central stud of the hotplate body 3 located within the inner flange edge. On the outer circumference of flange edge 8 is mounted a support ring 9 located adjacent to the cooking surface 4 and which is supported on a circular shoulder remote from the cooking surface 4 and radially outwardly connected to the flange edge 5 and which in cross-section can be approximately U-shaped with divergent U-legs, in such a way that the radially outer, outwardly inclined profile leg with its lower ring edge forms a support edge, which is located radially outside the furthers outer circumference of the hotplate body 3 located in the vicinity of cooking surface 4. By means of said support edge, in the fitted state the electric hotplate 2 engages in braced manner on the top of a mounting plate outside a mounting opening, while the underlying part of the hotplate 2 projects beyond the underside of the mounting plate. No hotplate parts project beyond the underside of the hotplate 2 or the cover plate 7 located in a plane parallel to cooking surface 4, so that on mounting the hotplate 2 on a planar support surface an annular base is formed in the vicinity of the flange edge 5.

According to the invention, for the packing-like stacking of a plurality of electric hotplates 2 is provided a number of separate, preferably substantially identical pallet plates 10 corresponding to the number of stacking layers, in such a way that all the hotplates 2 of the particular stacking layer are directly positively secured with respect to one another. Between each pallet plate 10 and the cooking surfaces 4 of hotplates 2 of the adjacent stacking layer is arranged a compression elastic spacer 11 with a thickness in the relaxed or relieved state of approximately 3 to 4 mm and in the form of a plastic foam mat, so that it is completely impossible for there to be a direct contact between the pallet plate 10 and cooking surfaces 4, but there is a supporting action with a very high friction coefficient and a high degree of surface protection. Thus, superimposed stack layers are secured with respect to one another solely by friction.

The stack rests on and defines a reference plane. The stack, including hotplates 2, pallet plates 10 and spacers 11, bounded at its outsides by envelope surfaces at right angles to one another is appropriately arranged on a support pallet, which in ground plan is slightly larger than the stack, so that on all sides it projects slightly beyond its vertical envelope surfaces. The support pallet 2 appropriately comprises a plate-like support grating provided on the top surface, which is positioned on horizontal girders interconnected on their underside by laths or a further support grating, in such a way that between the girders are left gaps for the engagement of a forklift truck, tension belts, etc., The bottom pallet plate 10 does not stand directly on support pallet 12 and there is instead intermediately provided a compression elastic intermediate layer, which is appropriately formed by the bottom of a cardboard box 14 of a packing sleeve 13, whose inside diameter is roughly the same as the ground plan of the pallet plates 10, so that the support plate 12 projects only slightly on all sides beyond the packing sleeve 13. The cardboard box 14, which extends roughly over the entire height of the stack or by approximately two stacking layers less, is closed on its top surface with a cardboard packing lid 15 closely engaging around the outside of its upper edge and whose cover wall, optionally accompanied by the interposing of a spacer 11, is directly supported on the upper sides, in the present case formed by the cooking surfaces 4, of the electric hotplates 2 of the top stacking layer, so that it can be tensioned downwards without striking against the cardboard box 14. On the top of the cover wall of the packing lid 15 rests a clamping plate 16 in the form of a lath grating having roughly the same basic shape as the lid 15 in such a large area manner that in each case one lath extends over all the stacking columns juxtaposed in a row and consequently each of these rows can be braced over such a lath in the downwards direction against the support pallet 12 and accompanied by the compression of spacers 11. Thus, the stacking layers 18 of stack 17 can be so immovably secured against one another that even high transverse loads, such as can e.g. occur in the case in emergency braking of a transportation vehicle, cannot lead to transverse displacements within the stack 17.

Each pallet plate 10 has a number of deep-drawn, identically large or identical flat shells 19 equal to the number of stacking columns or hotplates 2 per stacking layer, which are equidistantly juxtaposed and successively arranged in a rectangular line and column grid or pattern, in such a way that the outermost flat shells 19 are in each case spaced from the adjacent outer edge of the pallet plate 10, the spacing being at least as large or larger than the intermediate spacing between adjacent flat shells 19. Each flat shell 19 has a substantially planar, thin-walled shell bottom 20 parallel to the plane of pallet plate 10, which on the outer circumference passes in one piece into a frustum-shaped shell surface 22 diverging in acute angled manner to the shell opening 23 under an angle of more than 45° or approximately 60°. The outsides of the shell bottoms 20 of all the flat shells 19 of the particular pallet plate 10 remote from the shell openings 23 form a single support surface 21 for the same for providing a support with respect to the adjacent stacking layer.

The internal height 24 of the flat shells 19 which, in addition to the thickness or wall thickness of the shell bottom 20, is the same as the total height or thickness of the pallet plate 10, is 15 or 10 mm, e.g. approximately 6 mm smaller than the mounting depth 25 of electric hotplates 20 to be measured from the support edge of the support ring 9 to the underside and is namely at the most half as large or smaller. The greatest inside diameter of the shell bottom 20 or the smallest inside diameter of the shell surface 22 subsequently located thereon is slightly larger than the outside diameter of the hotplate 2 in the vicinity of its underside determined by the circumference 8 of the flange edge 5, so that the outer boundary of the shell bottom 20 is approximately congruent with the outer boundary of the flange edge 5 and the cover 7.

The flat shells 19 of each plate 10 are located in a planar, central plate field 26 passing over all said shells 19, which has substantially linear outer boundaries, which have a smaller spacing from the outer flat shells 19 than their intermediate spacings and in the vicinity of the flat shell 19 located at the corners of the plate field pass into one another via quadrantal transition sections, which are curved about the central axis of the associated flat shell or follow the outer boundary thereof with a constant spacing. In the plane of said plate field 26 are located the shell openings 23, in such a way that the pallet plate 10 has no parts projecting over the side of the plate field 26 remote from shell bottoms 20.

Following on to the plate field 26 is provided a channel 28 surrounding it uninterruptedly on all sides and whose bottom 29 is in the plane of the shell bottom 20 and whose channel flanks also diverge towards the channel opening on the same side as the shell openings 23 under the same angle as the shell surfaces 22. The inner channel flank passes directly into the plate field 26 and forms its outer boundary. The outer, equally high channel flank forms a circumferential edge 27, which in the plane of the shell openings 23 or the channel opening passes into an outwardly directed edge flange 30, whose width is significantly smaller than the channel depth and whose edge determines the outer boundary of the pallet plate 10. The pallet plate 10 consequently has two substantially planar, parallel outsides, whereof one is formed by the outside of the shell bottoms 20 and the channel bottom 29, while the other is formed by the side remote therefrom of the plate field 26 interrupted by flat shells 19 or shell openings 23 and the edge flange 30.

For reciprocally securing superimposed stacking layers, as stated, there is in each case a slip preventing means 31, which is on the one hand formed by spacer 11 and on the other by a roughening, a profiling, projections, such as spherical segmental studs 32, etc,. which project beyond the outside of the in each case associated shell bottom remote from the shell interior to a limited extent and in particular by less than the height 24 of the pallet plate 10 or by a few millimeters. The studs 32 which appropriately project by less than 3 mm or even by less than the wall thickness of pallet 10 are stamped out of the particular shell bottom 20, so that they form corresponding depressions on its inside. Appropriately the studs 32 are arranged in concentric rings, whereof the outermost ring is arranged in spaced manner within the base of the hotplate 2 determined by the flange edge 5, while the innermost ring can be so adapted to the inside diameter of the central depression in the cooking surface 4 of hotplate 2 that it engages in sintering manner therein and it is even possible to obtain a type of positive transverse securing of superimposed stacking layers.

As a result of the inventive construction the total height of stack 17 only slightly exceeds the sum of the heights of the superimposed electric hotplates 2, namely exceeds the same solely by the sums of the e.g. 1.5 mm wall thickness of the pallet plates 10, plus the squeezing thicknesses of spacers 11 reduced to a fraction of a millimeter in the vicinity of the stud-like support surfaces 21.

The pallet plates 10 can be in the form of flat plates of a relatively compression-resistant plastic in a one-part mould by vaccum deep drawing and the material used is appropriately polystyrene. Following production and removal from the stack, the pallet plates 10 can be directly assembled in closely nested manner to form a flat stack. The basic shape of the spacer 11 is appropriately at least as large as the plate field 26 or is slightly larger, but can be smaller than the basic shape of the pallet plates 10, so that the spacers 11 do not project beyond the outer boundaries thereof, but with their outer edges offer a protection for the outsides of the cooking surfaces 4 and the support rings 9 of the outer hotplates 2.

Each hotplate 2 has for its electrical connection in the fitted position or for its electrical connection with a manually operated switching means on its underside two or more and in particular four juxtaposed connecting members 33 in the form of parallel, pin-like plug members, which together form a connecting or attaching plug. In the represented embodiment, the connecting members 33 are formed by angular, linear legs or ends of connecting wires, which pass through an insulating piece 34, which is fixed in the vicinity of the bottom of a depression of the cover plate 7 and which on the inside of the latter are connected with their associated inner, also angular leg by spot welding or the like directly with the downwardly projecting terminal pins of the heating resistors 6. The connecting members 33 project from the insulating piece 34 in the direction of the outer circumference 8 of flange edge 5, but are slightly set back with respect to said outer circumference 8 or with respect to the inner circumference of the flange edge 5 and therefore with respect to said base of the hotplate 2. Over the entire length, the connecting members 33 are located in the vicinity of a depression shaped into the bottom of cover plate 7 and whose depth is at least as large as the cross-sectional width of the connecting members 33, so that the latter can be completely received in the depression without projecting over the base surface or underside of hotplate 2. The connecting members 33 can be constructed in the manner of resilient arms and in the relieved state can project beyond the underside or base surface of the associated electric hotplate 2. Under the stack weight or tension the connecting members 33 are pressed into the depression by engaging on the associated shell bottom 20. As soon as the hotplate 2 has been removed from the stack or the hotplate 2 and the pallet plate 10 receiving the same in its flat shell 19 are raised from one another, the connecting members 33 in automatically resilient manner can move over and beyond the underside of hotplate 2, so that in sloping manner they are readily accessible for assembly or connection.

Figure 5:
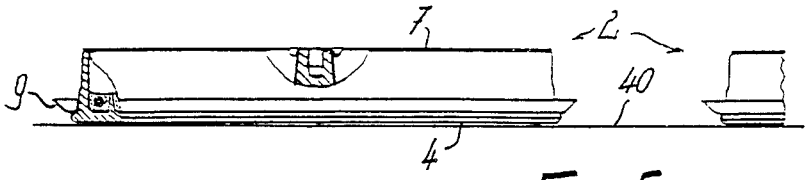
FIGS. 5 to 10: Individual, successive fitting phases during the assembly of a mounting plate with electric hotplates.
Figure 6:
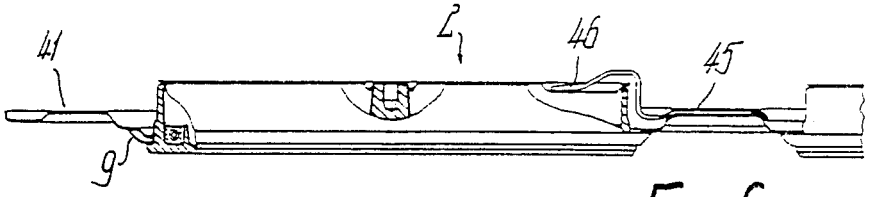
Figure 7:
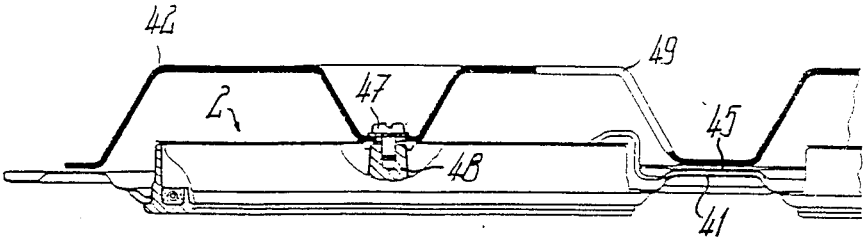
Figure 8:
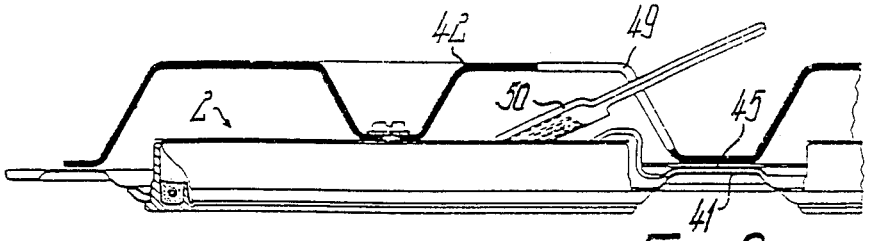
Figure 9:
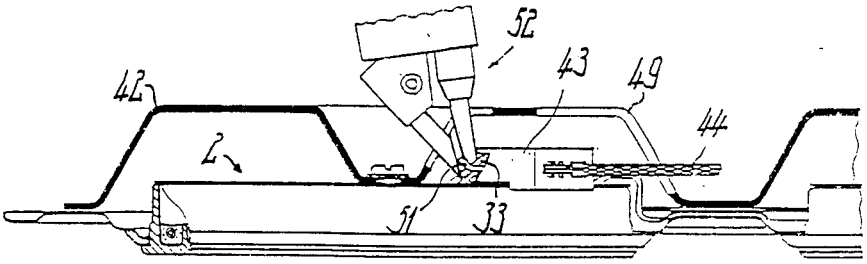
Figure 10:
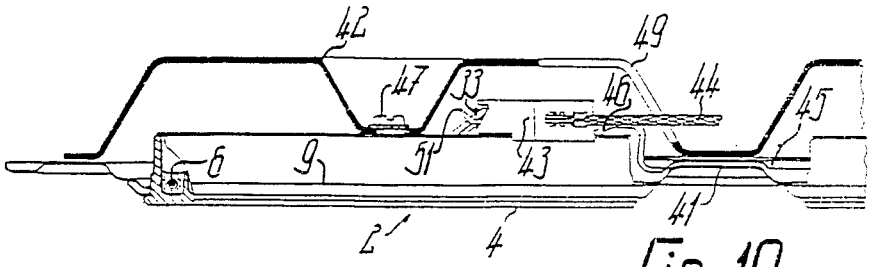

The electric hotplates 2 are used for fitting in a mounting plate, which is in general traversed by three or four mounting openings for receiving electric hotplates. According to FIGS. 5 to 10 for assembly purposes a corresponding number of hotplates 2 are removed from at least one stack, the hotplates 2 generally differing and can therefore be taken from a corresponding number of stacks with in each case the same number of hotplates. If the hotplates are stacked in accordance with FIGS. 1 and 4, then they are reversed or turned over after removal. If stacked in inverted manner, together with the pallet plates, then there is no need to turn them over. In any case, said hotplates 2 are placed in the spatial association given by the mounting openings on a substantially planar support surface 40 by their cooking surface 4 and simultaneously they are so aligned with respect to the central axes at right angles to the cooking surfaces 4 that their connecting members 33 or their attaching plugs are aligned in the desired predetermined position. This process appropriately takes place fully automatically using at least one programmable handling automation, which can e.g. have an electromagnetic for holding or carrying the particular hotplate 2.

After setting down the electric hotplates 2 using the same or another programmable handling means the mounting plate 40 comprising a profiled sheet metal plate of stainless steel or the like is placed in the predetermined association upside down on the hotplates 2, in such a way that they receive the same in their mounting opening which are generally provided in the vicinity of protuberances. The mounting plate 41 is loosely placed with its underlying top surface substantially exclusively only on the support edges of the support rings 9 of hotplates 2. In the upside down position a thicker sheet metal intermediate part 45 is fully automatically placed on the upper underside of the mounting plate 41 using the same or a different programmable handling means, said profiled intermediate part 45 spacedly surrounding the hotplates 2 and not extending to the outer boundaries of mounting plate 41. In addition, torsion preventing means for the hotplates 2 are fitted and this can take place in simple manner together with the mounting of the intermediate part 45, if the latter e.g. has torsion preventing fingers 46 constructed in one piece therewith, whereof in each case one engages in a depression, adjacent to the depression for the connecting members 33, in the cover plate 7 of hotplate 2 or in another countermember.

In the upside down position is then placed on intermediate part 45 a clamping part 42, supported with respect to the top underside of the mounting plate 41 adjacent to its protuberances and around each hotplate 2. The clamping part forms in the vicinity of each hotplate 2 a substantially flat shell-like tension shell substantially covering its underside. The clamping part 42 is once again mounted in fully automatic aligned manner using the same or a different programmable handling means. Using the latter or a separate, programmable handling means through a passage opening in the bottom of each tension shell is passed a fastening bolt 47, e.g. in the form of a cap screw and is screwed into a taphole of the central stud 48 of hotplate 2, the tension shell being so resiliently braced that on the one hand, under resilient tension, its edge engages on one side and the support ring 9 on the other on the mounting plate 41. The bottom of the tension shell can have a shaped out part in the vicinity of the fastening bolt 47 and its end wall is braced against the end face of the central stud 48.

In the vicinity of the connecting members 33 of the associated hotplate 2, each tension shell has a window opening 49 passing over part of its shell bottom and approximately over the entire height of its shell surface, through which the connecting members 33 remain accessible for connection. According to FIG. 8 through said window opening 49 acts a lifting tool 50 and with the latter the connecting members are transferred into the desired connecting position by bending away from the top underside of the electric hotplate 2. Tool 50 can be fully automatically operated by the same or a separate handling means.

After removing the e.g. spoon-shaped lifting tool 50 using the same or a separate handling means, fully automatically a connecting piece 43 is so brought through the window opening 49 to the connecting members 33, that its free projecting connecting countermembers 51 mesh in comb-like manner with the connecting members 33 and in each case two such members are juxtaposed pairwise and the inherently rigid, but resiliently joint-like connecting members are automatically oriented on guide and threading surfaces, which are provided on the countermembers 51 or on an insulating member of connecting piece 43 receiving the same. In the represented embodiment the connecting piece 43 is constructed for spot welding connection to the connecting members 33 and not for plug-in connection. For producing this connection either through the window opening 49 or through a separate, further window opening in the tension shell is fully automatically introduced by a programmable handling means multiple precision spot welding tongs 52 which are brought up to the pairs of connecting members and countermembers, said tongs 52 having a number of individual tongs corresponding to the number of said pairs. Prior to the moving up of the welding tongs 52 or as a result of this, a transverse movement of the connecting piece 43 can lead to the connecting members and countermembers 33, 51 being engaged with one another for producing the welded joints. All the welded joints for all the connecting members 33 are produced simultaneously. The countermembers 51 are electrically conductively connected to insulated, inherently rigid connecting lines 44, which are connected on the side remote from the countermembers 51 to the connecting piece 43 or its insulating body. The connecting piece 43 is then completely located within the tension shell, while the connecting lines 44 are led out through the window opening.

Following the fully automatic moving out of the welding tongs 52, the window opening 49 or window openings can be fully automatically closed with a cover or the like, except for the passage of the connecting lines 44, using the same or a separate handling means. Also an optionally present grounding connection, which can be fixed to member 42, as well as a connecting tension relief means for connecting piece 42 can be fully automatically fitted using the same or separate handling means.

Finally, in the aforementioned manner the mounting plate is removed by the same or a separate programmable handling means from the assembly table or the support surface 40 and placed on a stack, so that a further assembly cycle can commence. The inventive construction is not only suitable for mounting plates made from the sheet metal, but also for those of hard glass or the like, such as are e.g. described in DE-OS No. 33 17 624, to which reference should be made for further details and effects.

Due to the fact that the hotplates 2 in the stacking columns are always equiaxially arranged, a very reliable removal access in each stacking layer is ensured. The pallet plates 10 can have reciprocally alignable or in stack reciprocally aligned engagement members 53, e.g. in the form of holes, which are located outside the plate field 26 in the vicinity of the corners thereof in the channel bottom. These engagement members, e.g. through insertion of bars entending above the stack height are suitable for congruently reciprocally orienting or aligning the pallet plates 10. However, they can also serve as markings for a sensor of the handling means, in order to determine the position of the stack. As the four corners of the pallet plates or on parts thereof or areas of the stack it is possible to fit orienting means for a search camera or a similar sensor, which transfers the orientation information to the robot. These orientation aids are in particular formed by members 53.

We claim:

1. A hotplate stacking aid for stacking a number of electric hotplates in at least two superimposed stack layers of a stack, the stacking defining a reference plane with a bottom side, said stack layers defining stacking planes, each of said hotplates determining a thickness extension and a stack orientation with respect to said reference plane, said stacking aid comprising:

a total number of intermediate aid members including at least one intermediate aid member, each said aid member being provided for arrangement between superimposed hotplates;

bearing surfaces for a centered reception of each of said electric hotplates, said bearing surfaces being formed by said intermediate aid members, and wherein a number between one and substantially said total number of intermediate aid members provided for at least one said stack layer are formed by flat shells of at least one pallet plate, said flat shells having shell bottoms and opposite shell openings, said flat shells having a shell depth extension substantially smaller than said thickness extension of said hotplates, each of said shell bottoms having a bottom outer side forming a support surface for supporting engagement with an adjacent hotplate of an adjacent one of said stack layers, means being provided for receiving at least one of said hotplates in one of said flat shells in a same stack orientation as said adjacent hotplate in said adjacent stack layer, thereby providing a pallet stack when said stack layers receive said hotplates.

2. The stacking aid according to claim 1, wherein a plurality defining an entire number of said flat shells is provided for arrangement in at least one stack layer, substantially said entire number of flat shells being formed by a one-part pallet plate.

3. The stacking aid according to claim 1, wherein all of a plurality of pallet plates provided for substantially all of said at least two stack layers are substantially identically constructed.

4. The stacking aid according to claim 1, wherein at least one said at least one pallet plate is constructed as a flexible profile plate having a substantially constant wall thickness over an entire plate extension and being a deep drawn plastic plate.

5. The stacking aid according to claim 1, wherein at least one of said flat shells is adapted to a circumference of an outer flange rim providing an underside of a hotplate body of one of said hotplate to be received in said flat shell, said underside having a smaller width than a support ring of said hotplate.

6. The stacking aid according to claim 5, wherein said flat shells and said entire pallet plate have a height extension smaller than an engaging depth extending along said hotplates, said shell depth being smaller than a spacing between said underside of said hotplate and a support edge of said support ring.

7. The stacking aid according to claim 1, wherein all said shells of at least one said at least one pallet plate are provided in the vicinity of a central substantially planar plate field of said pallet plate, said shells projecting beyond a side of said pallet plate substantially by said depth extension.

8. The stacking aid according to claim 7, wherein said at least one pallet plate has a circumferential edge angled to a side of the pallet plate providing said shell openings, said circumferential edge emanating from a bottom of a channel profile surrounding said plate field and having substantially a same depth extension as the shells, said circumferential edge providing an outwardly directed edge flange.

9. The stacking aid according to claim 1, wherein at least one of said shells has a bottom provided with a slip preventing means projecting beyond said bottom outer side, said slip preventing means being formed by shaped-out studs providing said support surface.

10. The stacking aid according to claim 1, further comprising a compression elastic spacer for arrangement between said shell bottoms and a cooking surface of the hotplate located in an adjacent stack layer, the compression elastic spacer having a flexible foam plate extending substantially over an entire extension of an associated one of said at least one pallet plates.

11. The stacking aid according to claim 1, wherein said pallet plate is constructed for direct stacked engagement between two substantially similar pallet plates.

12. The stacking aid according to claim 1, further comprising a support plate formed by a standard pallet, for receiving a lowermost bottom stack layer of said pallet stack, the support plate laterally projecting slightly with respect to the pallet plate.

13. The stacking aid according to claim 1, further comprising an inherently rigid sleeve made from sheet material for receiving said pallet stack in the packing sleeve, said packing sleeve being closed with a removable packing lid.

14. The stacking aid according to claim 1, further comprising bottom and top clamping plates to be located on a top side and a bottom side of said pallet stack, said bottom clamping plate being formed by a support pallet and said top clamping plate by a planar grating plate located on a packing lid.

15. The stacking aid according to claim 1, wherein when assembled to form said stack all said hotplates are arranged with the same stack orientation and are juxtaposed in each stack layer in a pattern.

16. The stacking aid according to claim 1, wherein when assembled to form said pallet stack, cooking surfaces of said hotplates are oriented up.

17. The stacking aid according to claim 1, wherein markings associated with individual hotplates in said pallet stack are provided on at least one said at least one pallet plate.

18. The stacking aid according to claim 1, wherein profiles formed by holes are provided in corner regions of at least one said at least one pallet plate for aligning a withdrawing robot with respect to said pallet stack.

19. The stacking aid according to claim 1, wherein said shell bottoms of at least one said at least one pallet plate have bottom inner sides provided for directly supportingly engaging said hotplates of an associated one of said at least two stack layers, said bottom outer sides being provided for supportingly engaging an adjacent one of said stack layers.

20. The stacking aid according to claim 1, wherein said shell bottoms are substantially closed.

21. The stacking aid according to claim 1, wherein the flat shells of superimposed pallet plates substantially coaxial and identical.

22. The stacking aid according to claim 1, wherein each shell bottom remote from its bottom outer side has a bottom inner side for directly bearingly receiving an electric hotplate, said shell bottom thereby providing an intermediate load bearing link between two superimposed electric hotplates.

* * * * *